US012420998B2

(12) United States Patent
Caenen et al.

(10) Patent No.: US 12,420,998 B2
(45) Date of Patent: Sep. 23, 2025

(54) PACKAGED FIBROUS MATERIAL BALES COMPRISING LOWER SHEET

(71) Applicant: ACETATE INTERNATIONAL LLC, Irving, TX (US)

(72) Inventors: Philip Caenen, Lanaken (BE); Christopher Bundren, Blacksburg, VA (US); Christophe Loix, Gelik (BE); Frank Olaerts, Lanakan (BE); William Sanderson, Blacksburg, VA (US)

(73) Assignee: Acetate International LLC, Irving, TX (US)

( * ) Notice: Subject to any disclaimer, the term of this patent is extended or adjusted under 35 U.S.C. 154(b) by 100 days.

(21) Appl. No.: 17/970,176

(22) Filed: Oct. 20, 2022

(65) Prior Publication Data

US 2023/0130837 A1 Apr. 27, 2023

Related U.S. Application Data

(60) Provisional application No. 63/270,483, filed on Oct. 21, 2021.

(51) Int. Cl.

| | |
|---|---|
| ***B65D 85/07*** | (2017.01) |
| ***B65B 11/58*** | (2006.01) |
| ***B65B 63/02*** | (2006.01) |
| ***B65D 65/02*** | (2006.01) |
| *A24D 3/10* | (2006.01) |

(52) U.S. Cl.

CPC ..... *B65D 65/02* (2013.01); *B65B 11/58* (2013.01); *B65B 63/02* (2013.01); *B65D 85/07* (2018.01); *A24D 3/10* (2013.01)

(58) Field of Classification Search

CPC ..... B65D 65/02; B65D 85/07; B65D 71/02; A01F 2015/0745; B65B 27/125; B65B 63/02; B65B 11/58; A24D 3/10

USPC ..... 206/83.5, 442; 53/436

See application file for complete search history.

(56) References Cited

U.S. PATENT DOCUMENTS 2,539,725 A * 1/1951 Caraher ..... B65B 27/125 53/436
4,157,754 A * 6/1979 Bartsch ..... B65D 85/08 206/83.5
7,306,093 B2 * 12/2007 McLaughlin ..... B65B 1/24 206/83.5

(Continued)

FOREIGN PATENT DOCUMENTS

JP 2018079983 A 5/2018

OTHER PUBLICATIONS

International Preliminary Report on Patentability for PCT/US2022/047299 issued Apr. 23, 2024, 9 pages.

(Continued)

*Primary Examiner* — Steven A. Reynolds

(74) *Attorney, Agent, or Firm* — Kilpatrick Townsend & Stockton LLP

(57) ABSTRACT

Disclosed are packaged fibrous material bales and methods for packaging fibrous materials such as cellulose acetate tow bales. The packaged fibrous material bale may comprise a compressed fibrous material enclosed in packaging. The packaging may comprise an upper sheet and a lower sheet comprising a tab. After the residual forces in the packaged bale have equilibrated following pressing, greater than 99% of the surface area of the bale is enclosed by the packaging.

18 Claims, 4 Drawing Sheets

(56) References Cited

U.S. PATENT DOCUMENTS

| | | | | |
|---|---|---|---|---|
| 2004/0159658 | A1* | 8/2004 | McLaughlin | B30B 9/3032 220/4.21 |
| 2005/0011798 | A1 | 1/2005 | Nelson et al. | |
| 2005/0284775 | A1* | 12/2005 | McLaughlin | B65B 63/02 53/436 |
| 2006/0249406 | A1* | 11/2006 | Sanderson | B30B 9/3021 206/83.5 |
| 2009/0101525 | A1* | 4/2009 | Bundren | B65B 63/02 206/83.5 |
| 2013/0341380 | A1* | 12/2013 | Tambo | B65D 5/66 493/339 |

OTHER PUBLICATIONS

International Search Report and Written Opinion for PCT/US2022/047299 mailed Feb. 9, 2023, 12 pages.

* cited by examiner

PACKAGED FIBROUS MATERIAL BALES COMPRISING LOWER SHEET

CROSS-REFERENCE TO RELATED APPLICATION

This application claims priority to U.S. Provisional Application No. 63/270,483, filed on Oct. 21, 2021, the entire contents and disclosures of which are incorporated herein.

FIELD OF THE INVENTION

The present invention relates generally to packaged bales of fibrous material, wherein the packaging comprises an upper sheet and a lower sheet comprising a tab, as well as to methods for making same. In particular, the present invention relates to packaged cellulose acetate tow bales, wherein the lower sheet has a tab to reduce and/or eliminate quality issues associated with open corners caused by the bale pressing process.

BACKGROUND OF THE INVENTION

Methods and materials for packaging fibrous materials are known. Cellulose acetate tow, for example, is a fibrous material that is typically compressed into a bale for packaging, storage and shipment. Cellulose acetate tow is a continuous band or bundle of cellulose filaments that may be processed into cigarette filters. Generally, cellulose acetate tow has low bulk density, e.g., approximately 100 kg/m$^3$, and is compressed to increase this bulk density for improved handling and transport efficiency. After being compressed into a bale, cellulose acetate tow exerts an expansion force, which must be effectively controlled in order to maintain the desired bulk density and size for storage and shipment. Packaging materials, such as polyester straps, are typically used to counteract the expansion force of the tow bale. Because of press size restrictions, however, even known packaging methods still result in exposed corners following storage of the bale for at least 48 hours.

Numerous packaging methods have been suggested by the prior art. U.S. Pat. No. 8,161,716 discloses a packaging method for a filter tow bale including excessively compressing a distance between press bases to a height lower than a desired height of a packaged bale by 50 to 250 mm, more preferably 80 to 200 mm, further preferably 90 to 180 mm, then adjusting the distance between the press bases to the desired height in a packaged or non-packaged state, and then releasing a pressing force applied on a pressed bale.

U.S. Pat. No. 5,732,531 discloses a method for wrapping a bale of compressed, resilient fibers comprising the steps of: providing a reusable bale wrap kit which includes at least two pieces. Each piece, when joined with the other piece, is adapted for substantially enclosing and containing the bale of compressed, resilient fibers. Mushroom and loop fasteners are located along an edge portion of each piece and are adapted for joining the pieces to one another. Uncompressed, resilient fibers are provided. A portion of the uncompressed, resilient fibers are surrounded with the kit. Those fibers are compressed, and the mushroom and loop fasteners are engaged.

U.S. Pat. No. 4,157,754 discloses compressed that fibers, filaments, or cabled tows, which are under an internal pressure of at least 0.2 daN/cm$^2$, are packaged by means of an outer wrapping, the overlapping areas of the wrapping are held together by means of an adhesive, for instance a neoprene-chloroprene-rubber based adhesive. In this manner, it is possible to eliminate straps, belts or wires which have been conventionally used to hold the package. As shown in FIG. 1 of U.S. Pat. No. 4,157,754, the adhesive is a glue that is applied to the entire overlap area.

GB 1512804 claims a method of preparing and packaging fodder comprising the steps of partially wilting green herbage, inserting a compacted block thereof into a bag or wrapper of impermeable plastics material, hermetically sealing the bag or wrapper against ingress of air and, before or after sealing, providing a non-return valve to allow the contents to exhaust to atmosphere.

U.S. Pat. No. 4,577,752 discloses an improved high density tow bale wrapped with a cardboard or the like covering and held in compressed condition by multiple strappings which extend around the bale, the tow bale having on its bottom a pattern of multiple pads for supporting the bale on a floor and unrelieved areas between the pads for receiving the strappings therealong.

JP2018-079983 describes a method for packaging a fibrous material, the method comprising: a) placing the fibrous material between an upper sheet and a lower sheet; b) compressing the fibrous material in a press to form a bale; c) substantially enclosing 100% of the surface area of the bale with packaging comprising the upper sheet and the lower sheet; and d) securing the packaging around the bale to form a packaged bale; wherein greater than or equal to 99%, 99.5% or 99.9% of the surface area of the bale is enclosed by the packaging after the packaged fibrous material is stored for at least 48 hours.

However, these existing packaging methods are complicated, expensive, and may be dangerous. For example, a metal strap under high pressure may snap during storage or may spring back during opening. Vacuum sealing and heat sealing require additional equipment and the seal must be sufficiently strong to maintain the vacuum or air-tight conditions during storage. Additionally, these existing methods may not adequately protect the fibrous material over time, as it expands after compression. Thus, the need exists for improved methods for packaging fibrous material, especially for packaging cellulose acetate tow bales, that adequately protect the fibrous material over time, as it expands after compression.

SUMMARY OF THE INVENTION

In some embodiments, the present invention is directed to a packaged fibrous material bale comprising: a) a fibrous material bale having an upper surface, a lower surface, and side surfaces; and b) packaging enclosing at least 99% of surface area of the fibrous material bale, the packaging comprising: i) an upper sheet enclosing the upper surface; and ii) a lower sheet enclosing the lower surface of the fibrous material bale and a portion of the side surfaces, a) wherein the lower sheet comprises a corner fold enclosing at least a portion of one of the side surfaces; and b) wherein the lower sheet comprises a tab located at or proximate to the corner fold, i.e., a tab inserted under the corner fold and closer to the fibrous material than the outer layer. The length of the tab may be from 30 to 99% of the corner fold height along the portion of one of the side surfaces. The lower sheet may comprise two tabs, preferably three tabs, more preferably four tabs. The packaging may further comprise a side sheet, wherein the side sheet overlaps the upper sheet and lower sheet. The fibrous material bale may comprise cellulose acetate tow. The lower sheet may consist of a continuous sheet with slits located at the tab. The lower sheet may have at least one set of score lines along a longitudinal length of the lower surface, preferably along a longitudinal length of at least two sides of the lower surface, more preferably along a longitudinal length of at least three sides of the lower surface, most preferably along a longitudinal length of at least four sides of the lower surface. The at least one set of score lines may comprise three sets of parallel score lines along a longitudinal length of the lower surface. The fibrous material bale may comprise two shorts sides and two long sides, and wherein the tab extends onto one of the two long sides. The lower sheet may comprise a tab located at or proximate to at least two corner folds. The fibrous material bale may further comprise d) a width of the tab is from 60% to less than 100% of the width between a set of innermost score lines and a set of outermost score lines. In some aspects, greater than 99.5% of the surface area of the tow bale is enclosed by the packaging, preferably greater than 99.9%, more preferable greater than 99.99%, as measured after the packaged fibrous material bale is stored for at least 48 hours.

In some embodiments, the present invention is directed to a method for packaging a tow bale, the method comprising: a) placing fibrous material between an upper sheet and a lower sheet, wherein the lower sheet comprises at least one tab along a longitudinal length of the lower sheet; b) compressing the fibrous material in a press to form a fibrous material bale; c) enclosing the surface area of the fibrous material bale with packaging comprising the upper sheet and the lower sheet, i) wherein at least a portion of the lower sheet comprising the tab is folded around at least one side of the fibrous material bale to form a corner fold; and d) securing the packaging around the fibrous material bale to form a packaged fibrous material bale; wherein at least 99% of the surface area of the fibrous material bale is enclosed by the packaging after the packaged fibrous material bale is stored for at least 48 hours. The lower sheet may have a longitudinal score line. The lower sheet may have at least two parallel longitudinal score lines. The lower sheet may be scored in each corner. The packaging may further comprise at least one side sheet. The fibrous material bale may comprise cellulose acetate. In some aspects, step a) further comprises enclosing the fibrous material in a non-sealed liner prior to placing the tow between the upper sheet and the lower sheet; and further wherein at least 99% of the surface area of the non-sealed liner is enclosed by the packaging after the bale is stored for at least 48 hours, preferably at least 99.5%, more preferably at least 99.9%, most preferably at least 99.99%. The packaging may comprise a cardboard material. In some aspects, step (d) comprises applying straps around the packaging, preferably plastic straps. In some aspects, step (d) comprises applying strap(s) horizontally and/or vertically around the packaging.

BRIEF DESCRIPTION OF THE DRAWING

The present invention will be better understood in view of the appended non-limiting figures, in which.

DETAILED DESCRIPTION OF THE INVENTION

Introduction

The present invention relates to packaged fibrous material bales, particularly to packaged cellulose acetate tow bales. The packaging includes an upper sheet and a lower sheet. The lower sheet comprises a tab which allows for coverage of a corner of the lower surface and side surfaces of the bale following 48 hours of storage of the packaged fibrous material bale. The lower sheet may comprise two, three or four tabs, allowing for a tab at one or more corners of the lower surface and side surfaces of the bale to be used to reinforce the packaging in those regions. The packaged fibrous material bales are therefore able to retain enclosure of at least 99% of the surface area of the bale once residual forces in the bale have equilibrated.

The present invention also relates to methods for packaging tow bales, the method comprising placing tow between an upper and lower sheet, compressing the tow in a press to form a tow bale, enclosing the surface area of the bale with packaging comprising the upper sheet and lower sheet, and securing the packaging around the tow bale to form a packaged bale. The lower sheet comprises a tab which allows for coverage of corners of the lower surface of the tow bale following 48 hours of storage of the packaged fibrous material bale. The lower sheet may comprise two, three or four tabs, allowing for a tab at one or more corners of the lower surface and side surfaces of the bale to be used to reinforce the packaging in those regions.

Without being bound by theory, the present inventors found that including a tab on the lower sheet overcomes problems associated with exposed fibrous material bale corners. Because of the internal forces in the fibrous material bale following compression, the compressed fibrous material exerts forces against any packaging applied thereto. These forces result in vertical as well as lateral expansion of the tow. As a result, packaging may be compromised, allowing for the fibrous material to be exposed to the environment. This exposure of fibrous material to the environment, especially to moisture, may then result in damage to the fibrous material. In the case of cellulose acetate tow bales, cardboard is a relatively inexpensive packaging method but it is non-resilient and prone to compromise, especially at fold locations and most especially at corner locations. Although straps may be used to help contain the bale, compromise of the cardboard packaging may occur at the corners of the packaging, especially the bottoms corners.

Figure 1:
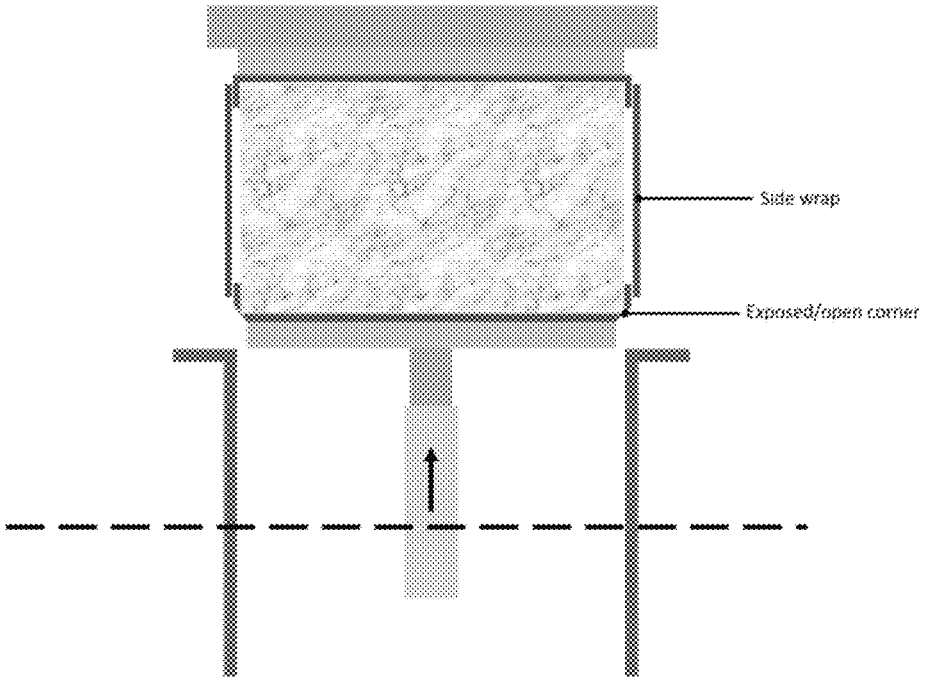
FIG. 1 (Prior Art)
FIG. 1 is an illustration of a fibrous material dressed with packaging in a fibrous material bale press.

The compromise of the bottom corners is caused, at least in part, to restrictions of how the lower sheet is situated when dressed in the press, as shown in FIG. 1. Due to the nature of the press design, the bottom sheet is folded around the bottom press stamp in the opposite direction, after which the bottom is retracted into the press box. The surface area of the press box is therefore larger, and closer to the dimensions of the bale than the bottom press stamp. The bottom press stamp needs to accommodate for the lower sheet being folded around it. After the pressing cycle is finished, the lower sheet is folded around the bale, which has the footprint of the press box. Thus, the lower sheet, which has a slightly smaller footprint to accommodate for counter-folding over the press stamp, leaves exposed corners on the bottom of the bale. These exposed corners may expand in size over time, e.g., over 48 hours or even longer, as the residual forces in the bale equilibrate.

Figure 2:
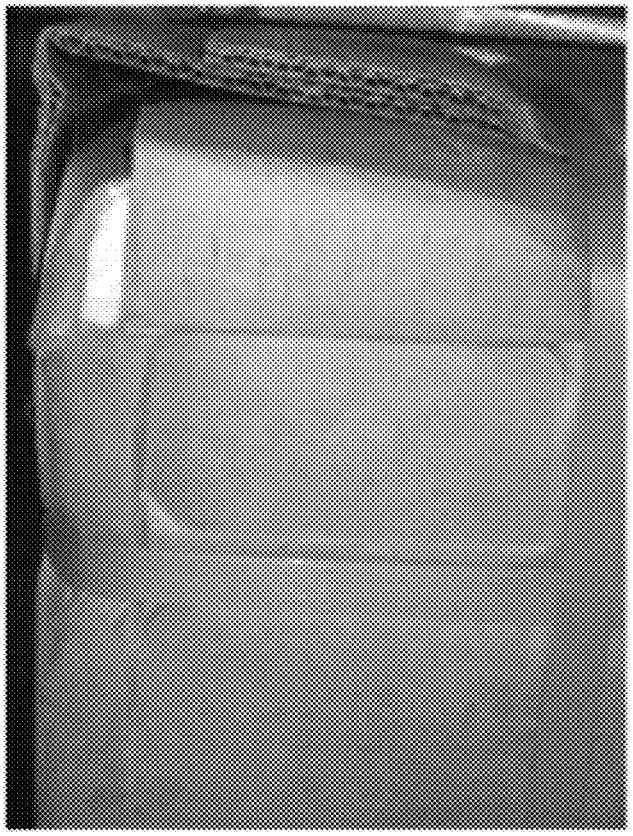
FIG. 2 (Prior Art)
FIG. 2 is an illustration of a packaged fibrous material bale with exposed surface area of the bale according to a comparative example.
Figure 3:
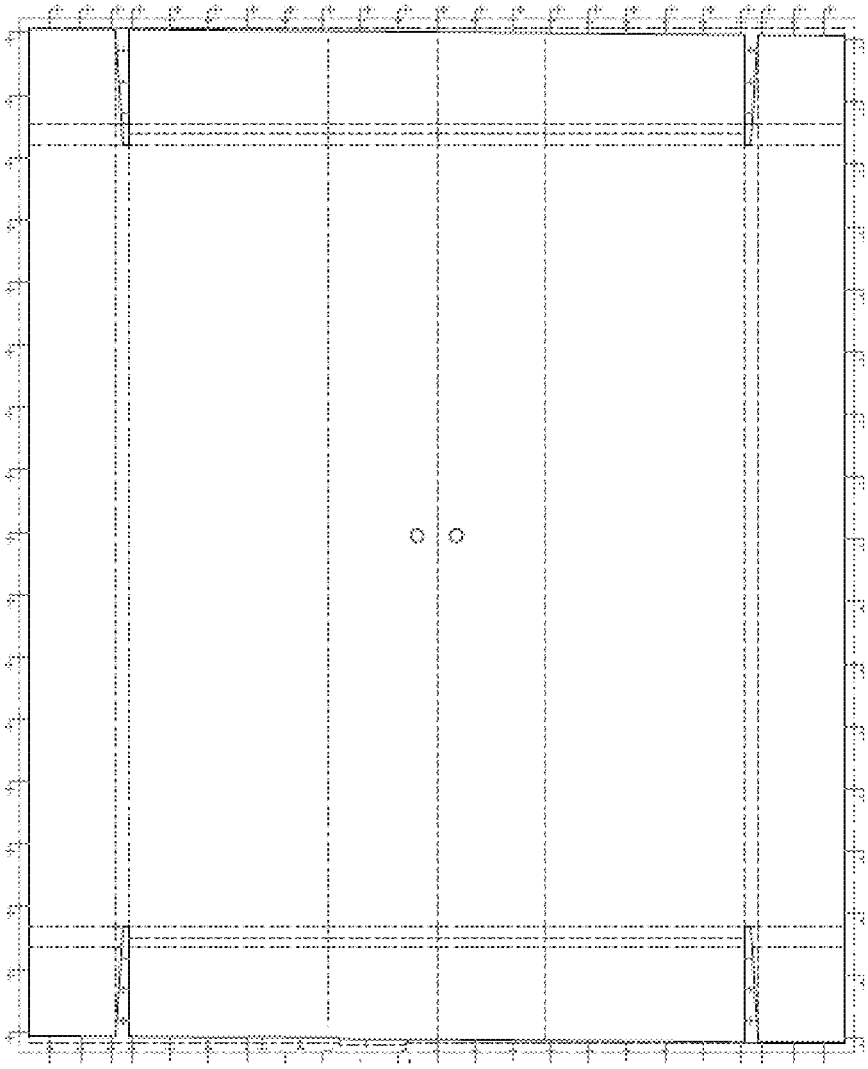
FIG. 3 (Prior Art)
FIG. 3 is a diagram of a lower sheet according to a comparative example.

FIG. 2 shows an exposed corner. As shown in FIG. 2, the cardboard packaging has been pushed away from the corner due to residual forces, leaving the corner open despite having enough material present to enclose the corner. The packaging used in FIG. 2, diagramed in FIG. 3, included slits rather than tabs. This resulted in a surface area of 12.33 $cm^2$ of tow exposed at the press and in 17.55 $cm^2$ of tow exposed after 2 weeks of storage (corresponding to 99.98% and 99.97% of bale coverage, respectively). During storage and shipping, as well as during debaling to make downstream products, such failure of the cardboard packaging, especially at the corners of the packaging, has deleterious effects. For example, because the tow is no longer covered by the cardboard packaging, it may be exposed to moisture and debris, for example. This may damage the fibrous material and may result in swelling of the material, tangling of the fibers, or tearing of the fibrous material. Additionally, the fibrous material may be stained or may acquire an odor as a result of exposure to the environment. Even including a liner has not been able to overcome this problem due to damage and/or tearing to the liner. To solve this problem, it has surprisingly and unexpectedly been discovered that by designing the corners of the lower sheet to include a tab, the failure of the packaging, specifically in the corners proximate to the lower sheet can be avoided.

The design of the lower sheet as described herein, i.e., including a tab, results in a packaged fibrous material bale resulting in an acceptable amount of fibrous material bale surface area coverage, e.g., at least 99%, at least 99.5%, at least 99.9%, or at least 99.99%. This acceptable amount of fibrous material bale coverage is determined at least 48 hours after removing the packaged fibrous material bale from the press. This 48 hour period is selected because at 48 hours, the internal forces in the bale will have substantially equilibrated, and the bale will have reached "steady state." As used herein, "substantially equilibrate" refers to at least 80%, e.g., at least 90%, at least 95%, of the internal forces in the bale equilibrating. Thus, the bale is not expected to expand further within the packaging after 48 hours.

The surface area of the lower sheet is greater than the surface area of the lower surface of the bale, allowing for the lower sheet to be folded onto the sides of the bale to form a corner fold. Each corner of the lower sheet may be scored to allow for easier folding and improved durability. Additionally, the longitudinal (perimeter flap edges) sides of the lower sheet may be scored. The upper sheet may similarly have a greater surface area than the surface area of the upper surface of the bale. The upper sheet may also be scored and may have a tab as described for the lower sheet.

Fibrous Materials and Compression Thereof

As described herein, the present invention is applicable to packaged fibrous material bales as well as to methods for packaging fibrous materials. The fibrous material may be any material comprising fibers that is packaged for use, storage and/or shipment. In some embodiments, the fibrous material may be selected from the group consisting of polyester, polypropylene, polyethylene, olefins, and other polymeric materials. In some embodiments, the fibrous material may be a grass or hay such as timothy hay, alfalfa hay, orchard grass hay, Bermuda grass hay, oat hay, clover hay, grass hay, fescue hay and tall fescue hay. In still further embodiments, the fibrous material may be selected from the group consisting of cotton, fiberglass insulation, beet pulp, and wood shavings. In preferred embodiments, as indicated, the fibrous material comprises, consists essentially of, or consists of tow, preferably cellulose acetate tow, which is typically compressed to form a bale prior to packaging. Methods for preparing and baling cellulose acetate tow are disclosed in U.S. Pat. Nos. 7,610,852; 7,585,442; 7,585,441; 8,308,624; 6,924,029 and 7,487,720, the entireties of which are incorporated herein by reference.

The fibrous material may be compressed or otherwise compacted prior to packaging. The compression is generally in a bale press, and the press is dressed with at least the upper sheet and the lower sheet. Compression during packaging may reduce the volume of the fibrous material by at least 10%, preferably at least 25% or more preferably at least 40%. In terms of ranges, the volume of the fibrous material may be reduced by compression from 10 to 80%, preferably from 25 to 75% or from 40 to 70%. Flammability of the fibrous material may be considered when determining the amount of compression, particularly for a fibrous material having a low ignition temperature, such as hay. In some aspects, the fibrous material, e.g., cellulose acetate tow, may be compressed by at least 40%, preferably at least 60%, or more preferably at least 70%.

After compression but prior to securing the packaging, the platens may be retracted or opened by a small amount. This retraction step may result in a volume increase less than 20%, e.g., less than 15% or less than 10%, optionally from 0.5 to 15%. After opening the platens to release the packaged bale, the resulting packaged fibrous material may be allowed to further expand, causing a limited degree of stretching of the upper and lower sheets and/or the straps, optionally resulting in a volume increase less than 20%, e.g., less than 15% or less than 10%, optionally from 1 to 15%, e.g., from 1 to 10%, calculated based on the volume or height difference at the time packaging has been completed to a time that expansion has substantially ceased.

As described in U.S. Pat. No. 7,610,852, incorporated herein by reference, the fibrous material may be laid into a can and then set into a press within the press walls. The fibrous material is then pressed between dressed platens. The platens may be dressed with at least some of the packaging, e.g., the upper sheet and bottom sheet. Additionally, at least one of the platens may be dressed with a liner, described further herein. When a liner is included, it is dressed on the top and/or bottom platen over the top and/or bottom sheet, so that the liner is in intimate contact with the fibrous material and the top and/or bottom sheet is in intimate contact with the liner. The platens may be flat platens, or may be shaped, depending on the degree of compression and the desired final shape of the bale. It is understood that by using shaped platens, the bale may initially be concave on the top and/or bottom surfaces. Over time, as the internal forces in the bale equilibrate, the bale is substantially flat, e.g., does not have a visibly convex appearance on the top or bottom. The substantially flat bale may be desirable, especially compared to a bale with a visibly convex appearance on the top or bottom of the bale, because the substantially flat bale can stored and shipped in a lateral position (not turned on its side) and because the debaling process is easier, e.g., results in less tangling of the tow fibers due to the flatness of the bale as compared to a convex bale. This debaling problem is especially relevant for cellulose acetate tow, which may have a packing density of at least 300 $kg/m^3$.

Upper, Lower, and Side Sheets

The upper sheet, lower sheet and when used, the at least one side sheet may be comprised of the same or different material. The sheets may be flexible or rigid and may be made from a textile, film or foil, such as a single layer extruded film or a multi-layer extruded film. The film or foil may comprise one or more of paper, polymers or metals. In one aspect, the upper and lower sheets comprise cardboard. In another aspect, the either or both sheets comprise polymer film or foil. The polymer film or foil may comprise ethylene/vinyl acetate copolymer, polyvinylidene chloride, polyethylene homopolymer, polypropylene homopolymer, ethylene/alpha-olefin copolymer, polyvinyl chloride, polyamide, polyester, and polystyrene. The polyethylene film may be a long-chain-low-density polyethylene film.

In some aspects, the sheets may be formed from woven or woven and coated polyester, polypropylene, polyethylene, scrims, and other fiber reinforced films, provided that the sheets have sufficient rigidity to suffer from the material bulging under residual fibrous material forces.

The sheets may further comprise modifiers, pigments, processing aids, anti-stats, and other additives to modify the properties of the layer. For example, the film may be liquid impermeable, vapor impermeable, or both. Each sheet may be one continuous sheet, containing no seams or perforations. In some embodiments, the sheets may comprise a fiber or string reinforced polymer film.

The sheets may be transparent, translucent or opaque, or may be a variety of colors. In one aspect, the film is black. In another aspect, the sheets are clear.

The sheets may have a thickness from 100 to 800 μm, preferably from 200 to 600 μm or more preferably from 300 to 400 μm. The sheets may have a tensile strength from 10 to 175 N/cm of width in both the machine and x-machine directions, preferably a minimum from 17 to 131 N/cm of width, more preferably a minimum from 43 to 87 N/cm of width. In some aspects, the sheets may have a tensile strength of approximately 87 N/cm of width. In order to maintain the desired final tow bale package height and volume, elongation of the sheets should not be excessive and may range from 1 to 20%, preferably from 1 to 10% in the load working range above.

In other embodiments, the sheets may have a thickness from 1 to 20 mm, preferably from 2 to 10 mm or more preferably from 2 to 5 mm. Sheets with such thicknesses may include fiberboard, solid fiber, cardboard, corrugated cardboard, and corrugated cardboard with flutes in between.

Securing the Packaging

The upper sheet, lower sheet, and when used, the at least one side sheet, i.e., the packaging, may be secured around the bale using tape, straps, adhesive (e.g., glue), or combinations thereof. In some aspects, no adhesive is used and the packaging is secured only by straps.

In some aspects, the packaging is secured with tape comprising a substantially planar substrate (optionally rolled in a tape roll) having adhesive on a surface thereof. The tape may be any tape that is sufficiently strong to withstand the expansive forces of the fibrous material without tearing or having excessive elongation causing excessive expansion after packaging as indicated above. When the fibrous material is a cellulose acetate tow bale, the forces on the tape may range from 10 to 175 N/cm, e.g., from 17 to 131 N/cm, from 43 to 87 N/cm, or up to 87 N/cm.

The tape may be selected to satisfy certain tensile strength, e.g., tensile load requirements and/or constant shear loads. The tensile load requirement is measured in Newtons (N) per centimeter (cm) of width in the cross-machine or primary load direction and may be measured according to ASTM D3759 or PSTC-131, incorporated herein by reference in their entireties. The tape may be able to withstand a tensile load from 10 to 175 N/cm, preferably from 17 to 131 N/cm, more preferably from 43 to 87 N/cm. In another aspect, the tape may be able to withstand a tensile load of at least 87 N/cm. Suitable tapes are described, for example, in U.S. Pub. No. 2014/0004765, EP 2631278A1, WO2013/037648A2, and WO2012/150099A1, the entireties of which are incorporated herein by reference.

The constant shear load is measured in kilograms per square centimeter and may be measured using ASTM 6463-99, procedure A, the entirety of which is incorporated herein by reference. The testing is conducted with the desired weights and the tape is capable of withstanding the constant shear load if it does not fail after 3000 minutes. Fail is defined as slipping or separation of the tape prior to 3000 minutes. The tape may be able to withstand a constant shear load from 0.5 to 10 N/cm$^2$, preferably 0.6 to 7 N/cm$^2$, more preferably from 2 to 6 N/cm$^2$, most preferably from 4 to 6 N/cm$^2$. In another aspect, the tape may be able to withstand a constant shear load of at least 4 N/cm$^2$.

Other properties of the tape may also be considered when selecting a tape for the inventive method, including, tear strength, bond strength, viscosity, glass transition temperatures, elongation at break, peel strength and softening points. The tape may have a peel strength, the ability of the tape to resist forces that may pull it apart, sufficient to allow for ease of handling. The peel strength may be high enough for handling and tape application but lower than the forces requires to tear or cut the tape. The peel strength may be controlled by adjusting the tacking strength of the tape. In some aspects, the tape may have a peel strength of at least 2.7 N/cm, preferably at least 4.3 N/cm as disclosed in U.S. Pub. 2013/0233485, the entirety of which is hereby incorporated by reference. The peel force of the tape may depending on the width of the tape and the type of carrier used. The tape may have sufficient elongation to allow for ease of handling. In some embodiments, the tape may have an elongation from 1% to 25%, preferably from 1% to 15%, more preferably from 5% to 15%.

The tape may comprise a substrate or carrier, such as a paper, a laminate, a film, a foam or a foamed film. The film may be comprised of polyethylene, polyethylene terphthalate, polypropylene, polyester, polyamide (including nylon-6, nylon-6,6, nylon-6,9, nylon-6,10, nylon 6,12, nylon-11, and nylon-12), polyurethane, mixtures thereof, and copolymers thereof. The film may be mono- or biaxially oriented. The carrier may also comprise a textile carrier such as knitted fabrics, scrims, tapes, braids, tufted textiles, felts, woven materials (including plain weave, twill and satin weave), reinforced fabric, warp knits and nonwoven webs (including consolidated staple fibre webs, filament webs, meltblown webs, and spunbonded webs).

The adhesive may be a pressure-sensitive adhesive, e.g., a viscoelastic composition which, in the dry state at room temperature, remains permanently tacky and adhesive. Bonding is accomplished under gentle applied pressure instantaneously to virtually all substrates. Pressure-sensitive adhesives employed include those based on block copolymers containing polymer blocks. These blocks are preferably formed of vinylaromatics (A blocks) such as styrene, for example, and those through polymerization of 1,3-dienes (B blocks), such as, for example, butadiene and isoprene or a copolymer of the two. Mixtures of different block copolymers can also be employed. Preference is given to using products which are partly or fully hydrogenated. The block copolymers may have a linear A-B-A structure. It is likewise possible to employ block copolymers with radial architecture, and also star-shaped and linear multiblock copolymers. In place of the polystyrene blocks it is also possible to utilize polymer blocks based on other aromatics-containing homopolymers and copolymers (preferably C8 to C12 aromatics), having glass transition temperatures, for example, of greater than about 75° C., such as, for example, α-methylstyrene-containing aromatics blocks.

Also utilizable are polymer blocks based on (meth)acrylate homopolymers and (meth)acrylate copolymers with glass transition temperatures of greater than 75° C. In this context it is possible to employ not only block copolymers which exclusively utilize hard blocks based on (meth) acrylate polymers, but also those which utilize not only poly(meth)acrylate blocks, but also polyaromatics blocks or polystyrene blocks for example. The figures for the glass transition temperature for materials which are not inorganic and not predominantly inorganic (more particularly for organic and polymeric materials) relate to the glass transition temperature figure Tg in accordance with DIN 53765: 1994-03 (cf. section 2.2.1), incorporated herein by reference, unless indicated otherwise in the specific case. In place of styrene-butadiene block copolymers and styrene-isoprene block copolymers and/or their hydrogenation products, including styrene-ethylene/butylene block copolymers and styrene-ethylene/propylene block copolymers, it is likewise possible in accordance with the invention to utilize block copolymers and their hydrogenation products which utilize further polydiene-containing elastomer blocks such as, for example, copolymers of two or more different 1,3-dienes. Functionalized block copolymers such as, for example, maleic anhydride-modified or silane-modified styrene block copolymers may also be used. Typical use concentrations for the block copolymer lie at a concentration in the range from 30 wt. % to 70 wt. %, more particularly in the range from 35 wt. % to 55 wt. %.

Further polymers that may be included in the tape are those based on pure hydrocarbons such as, for example, unsaturated polydienes, such as natural or synthetically produced polyisoprene or polybutadiene, elastomers with substantial chemical saturation, such as, for example, saturated ethylene-propylene copolymers, α-olefin copolymers, polyisobutylene, butyl rubber, ethylene-propylene rubber, and also chemically functionalized hydrocarbons such as, for example, halogen-containing, acrylate-containing, or vinyl ether-containing polyolefins, which may replace up to half of the vinylaromatics-containing block copolymers.

The tape may further comprise a tackifier or tackifier resin. Suitable tackifier resins include partially or fully hydrogenated resins based on rosin or on rosin derivatives. It is also possible at least in part to employ hydrogenated hydrocarbon resins, examples being hydrogenated hydrocarbon resins obtained by partial or complete hydrogenation of aromatics-containing hydrocarbon resins (for example, Arkon P and Arkon M series from Arakawa, or Regalite series from Eastman), hydrocarbon resins based on hydrogenated dicyclopentadiene polymers (for example, Escorez 5300 series from Exxon), hydrocarbon resins based on hydrogenated C5/C9 resins (Escorez 5600 series from Exxon), or hydrocarbon resins based on hydrogenated C5 resins (Eastotac from Eastman), and/or mixtures thereof. Hydrogenated polyterpene resins based on polyterpenes can also be used. The tackifier resins may be employed both alone and in a mixture.

The tape may also comprise further additives, including light stabilizers such as UV absorbers, sterically hindered amines, antiozonants, metal deactivators, processing assistants, and endblock-reinforcing resins. Plasticizers may include liquid resins, plasticizer oils, or low molecular mass liquid polymers (including low molecular mass polyisobutylenes with molar masses less than 1500 g/mol (numerical average) or liquid EPDM grades).

The tape may have a liner material, with which the one or two layers of adhesive are lined up until use. Suitable liner materials include all of the materials listed comprehensively above. Preference, however, is given to using a nonlinting material such as a polymeric film or a well-sized, long-fiber paper.

A release agent may have been applied to the top face of the carrier or film. Suitable release agents include surfactant-based release systems based on long-chain alkyl groups such as stearyl sulfosuccinates or stearyl sulfosuccinamates, but also polymers, which may be selected from the group consisting of polyvinylstearyl carbamates, polyethyleneimine stearylcarbamides, chromium complexes of C14-C28 fatty acids, and stearyl copolymers, as described for example in DE 28 45 541 A, incorporated herein by reference in its entirety. Likewise suitable are release agents based on acrylic polymers with perfluorinated alkyl groups, silicones or fluorosilicone compounds, such as those based on poly (dimethylsiloxanes), for example. The release coat may comprise a silicone-based polymer. Particularly preferred examples of such silicone-based polymers with release effect include polyurethane- and/or polyurea-modified silicones, preferably organopolysiloxane/polyurea/polyurethane block copolymers, more preferably those as described in example 19 of EP 1336683B1, the entirety of which is incorporated herein by reference, including anionically stabilized, polyurethane- and urea-modified silicones having a silicone weight fraction of 70% and an acid number of 30 mg KOH/g. In one embodiment, the release layer comprises 10 to 20 wt. %, more preferably 13 to 18 wt. %, of the release-effect constituent.

Prior to packaging, the tape may be provided in the form of a roll, in other words in the form of an Archimedean spiral wound up onto itself, or with lining with release materials such as siliconized paper or siliconized film on the adhesive side. The reverse face of the adhesive tape may carry an applied reverse-face varnish in order to beneficially influence the unwind properties of the adhesive tape wound in the roll.

The tape may comprise reinforcements consisting of bidirectional laid/woven fabrics made from PET yarns or strings with low stretchability. In particular, warp knits with weft threads are suitable, since the lack of the corrugated structure of the warp thread in the case of laid fabrics means that no additional stretchability is introduced into the material. In other embodiments, the tape is free of reinforcing string or fibers.

The number of pieces of tape, placement of tape and width of the tape may be selected depending on the tape's tensile strength, shear strength, and the load requirements of the final application. As described above, for cellulose acetate tow application and tape in the described preferred strength ranges, the width of the tape is selected The thickness of the tape may also be selected depending on the application as well as the desired tensile strength and shear strength of the tape. Although the thickness of the tape may vary, it preferably ranges from 50 to 400 μm, e.g., from 75 to 200 μm or 100 to 150 μm. It is desirable to reduce the amount of tape used while still adequately securing the packaging.

In some aspects, the packaging is secured by straps. The straps may be secured by known means, including crimping or clipping for metal straps and friction welding for plastic straps. Although metal straps may be used, plastic straps are preferred since they are less expensive and less dangerous.

As with the tape, the number of straps, placement of the straps, and width of the straps may be selected depending on the tensile strength of the straps, the size and dimensions of the bale, and the load requirements of the final bale. In some aspects, the number of straps to be applied vertically is selected so that the number of straps are sufficient to withstand the total vertical expansion force of the fibrous material. In other aspects, the number and placement of straps is to prevent unacceptable bulging or distortion of the bale. In some aspects, two straps are secured vertically around the bale. In further aspects, three straps are secured vertically around the bale. In still further aspects, four straps are secured vertically around the bale. In further aspects, five or more straps are secured vertically around the bale. Due to the methods of compressing the fibrous material, straps that may be secured horizontally around the bale need not meet the same tensile strength requirements that straps that are secured vertically In some aspects, the horizontal straps are temporary straps to hold the packaging in place for a limited amount of time. In some aspects, two straps are secured horizontally around the bale. In other aspects, three straps are secured horizontally around the bale. In further aspects, four or more straps are secured horizontally around the bale.

Additionally, depending on the design of the upper sheet, lower sheet, and the number of side sheets, the vertical and horizontal straps may be placed differently. In some aspects, the vertical straps and the horizontal straps are placed evenly along the bale. In other aspects, such as when flat platens are used to compress the fibrous material, the vertical straps are not placed evenly, but are instead concentrated toward the middle of the bale, while the horizontal straps may still be placed evenly.

Packaging Methods and Packaged Fibrous Material Bale

As described herein, the invention relates to packaged fibrous material bales and method of packaging a fibrous material, e.g., cellulose acetate tow. The packaging comprises an upper sheet and a lower sheet, wherein the lower sheet comprises a tab. The tab may be in contact with the fibrous material (or liner, described herein) and a corner fold may be formed over the tab. The packaging of the fibrous material need not occur under vacuum, i.e., there is no vacuum sealing process used and the packaging is not purposefully made airtight. The fibrous material may be compressed prior to being packaged. The uncompressed fibrous material may be provided in any shape, e.g., cube, rectangular prism, cylinder, etc., preferably a rectangular prism. The resulting packaged fibrous material may also be in any such shape, though a cube or rectangular prism are the most common.

In further aspects, the uncompressed fibrous material may be provided in a liner, e.g. a liner between the fibrous material and the sheets, to inhibit odor or water infiltration, or other types of contamination. If used, the liner is preferably not used to contain any degree of compression of the fibrous material and is instead simply protective. The liner may be any conventional liner known in the art. The liner may be one piece, e.g., a bag, that is dressed on the top or bottom platen and then pulled over the compressed fibrous material so that it is in intimate contact with the compressed fibrous material. In further aspects, the liner may be two pieces, with one piece dressed on the top platen and one piece dressed on the bottom platen. Optionally, the liner may be secured with adhesive or tape. The same adhesive or tape described herein may also be used to secure the liner. In further aspects, the liner is not secured and is held in place by the packaging. The liner is not heat or vacuum sealed and accordingly is not air-tight.

Prior to packaging, the fibrous material may be stored in a large can, which serves to contain the fibrous material under atmospheric pressure. The can may be opened to provide the shaped fibrous material. The fibrous material may be compressed through known methods so as to form a cubic or rectangular prism-shaped compressed fibrous material. The fibrous material is placed between a lower sheet and an upper sheet before or after compression. The lower sheet rests on a lower platen and the upper sheet is removably attached or unattached to the upper platen. Each sheet may be placed on the respective platen and held in place by gravity, and/or may be attached to its respective platen by known means, including magnets, tape, rope, bungee cord, or other securing means. In some aspects, the surface area of the lower sheet and/or of the upper sheet is larger than the bottom surface area and/or top surface area of the fibrous material respectively.

Once the uncompressed fibrous material is placed between the lower sheet and the upper sheet (and optionally the liner), the press may be activated to enclose the fibrous material and either raise the lower platen or lower the upper platen to compress the fibrous material. Alternatively both upper and lower platen may be moved to compress the fiber. A target force is applied for a pre-determined dwell time to compress the fibrous material. After compression, a certain percentage of retraction and relaxation is permitted, as described above. The compressed fibrous material contains residual force that is maintained in the compressed fibrous material after the platens have been retracted, but prior to their fully opening to release the bale. In embodiments where the compressed fibrous material is a cellulose acetate tow bale, the residual pressure may be up to about 35 $N/cm^2$, for example.

Once the bale has been pressed, the upper sheet and the lower sheet may be wrapped around the bale to substantially enclose 100% of the surface area of the bale (or of the liner, when applied). In some embodiments, at least one side sheet is also used as part of the packaging. In some aspects, one side sheet is used and is wrapped horizontally around the bale. In further aspects, two side sheets are used and are wrapped horizontally around the bale. In still further aspects, two side sheets are used and each is wrapped vertically around the bale to enclose 100% of the surface area of the bale. The side sheets may overlap each other or themselves. The overlap may occur on the upper sheet, on the bottom sheet, or along the side of the bale, or any combination thereof.

Figure 4:
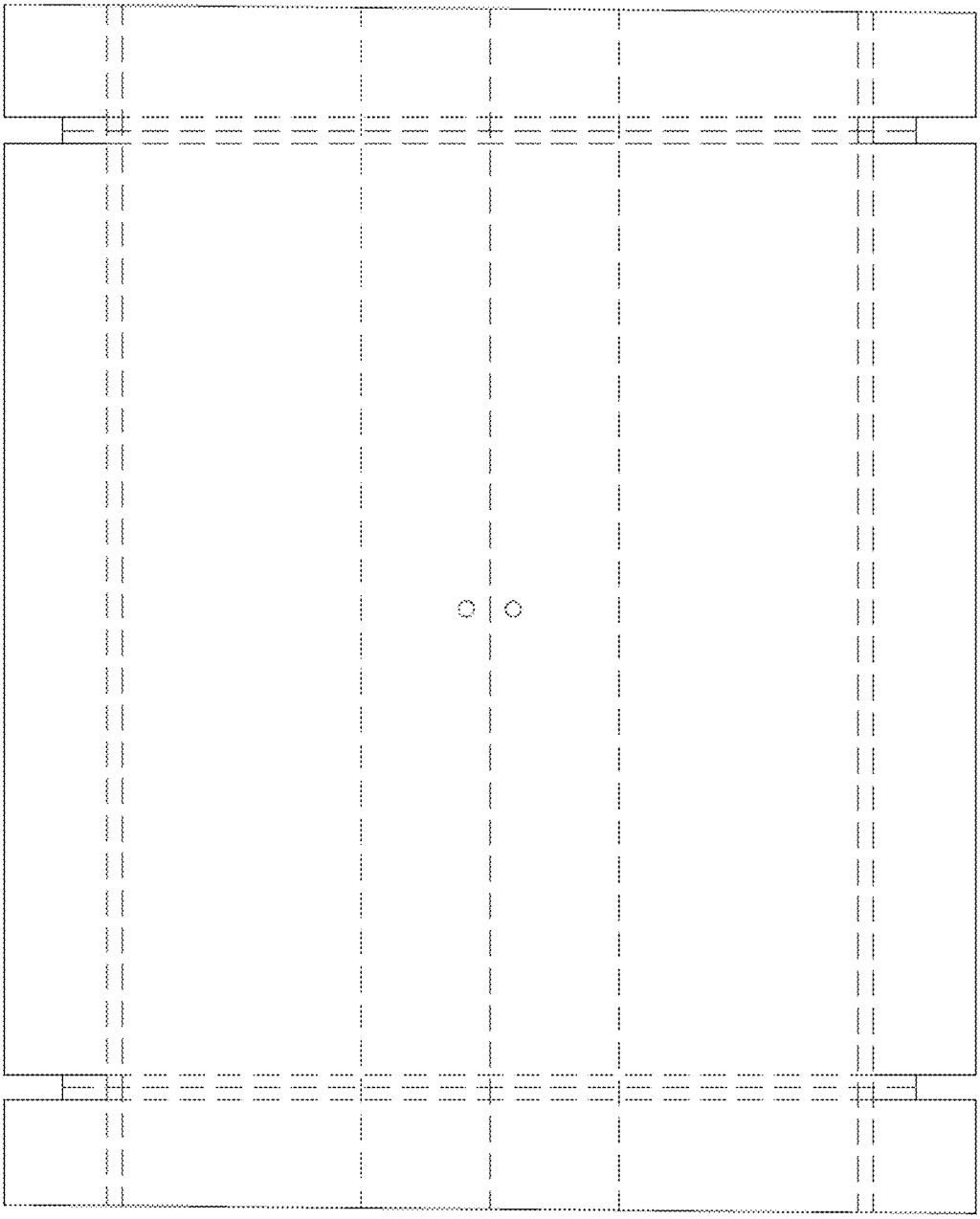
FIG. 4 is a diagram of a lower sheet in accordance with aspects of the present invention.

In aspects where the surface area of the lower sheet is greater than the surface area of the of the lower surface, and or where the surface area of the upper sheet is greater than the surface area of the upper surface, the lower sheet and/or upper sheet are folded to overlap at least one side surface of the bale. In order to facilitate both dressing of the platen and folding of the sheet, the upper sheet and/or lower sheet may have corners that are scored. In some aspects, the lower sheet is not cut or slit or modified to have material removed, except to form a tab. Scoring, as described herein, and as shown in FIG. 4, is not a full cut through the sheet, but allows for flexibility in the sheet to allow it to be folded without bending. The upper sheet may be cored, have slits, and/or may have corner cuts to allow for further flexibility in the material without removing material, but while maintaining integrity. Similarly, cutting a slit into each of the upper sheet corner to remove material allows for some give in the sheet without sacrificing strength. The slit may be in a Y-shape, a V-shape, or a U-shape, although other shapes are also possible. Further, the upper sheet may have a different slit shape than the bottom sheet. The lower sheet does not contain a slit or cut, because such slits or cuts are believed to contribute to exposed corners on the lower surface of the bale. Additionally, as shown in FIG. 4, the longitudinal (perimeter flap) edges of the sheets may be scored. The scoring may comprise at least one score line, e.g., one, two three, or more parallel score lines to allow the sheet to be folded around the platen, then folded again around the bale following compression and lateral expansion.

The tab may be configured to have a length and width based on the size of the bale. The tab may be square, rectangular, triangular, tongue-shaped, tapered, or any combination thereof, so long as the tab is able to meet the length and width configurations and to achieve the fibrous material surface area coverage. The tab may have a length that is from 30 to 99% of the corner fold height along a portion of one of the side surfaces, e.g., from 40 to 90%, from 50 to 70%, or from 55 to 65%. If the tab length is below 30%, it may be insufficient to prevent exposed corners, resulting in an unacceptable amount of fibrous material being exposed after 48 hours of storage. If the tab length is above 99%, there may be too much material, resulting in buckling and or inability to adequately fold the material. In some aspects, the tab may have a length from 40 to 131 mm, e.g., from 50 to 120 mm, from 60 to 110 mm, from 70 to 100 mm, or from 80 to 90 mm.

In aspects where the longitudinal flap of the lower sheet comprises multiple score lines, the tab may have a width, as measured from the innermost and outermost score lines, from 60 to 100% relative to the innermost and outermost score lines, e.g., from 65 to 95%, from 70 to 90%, or from 75 to 85%. Logically, the value cannot be above 100% and if the value is below 60%, there is insufficient material to cover the corner.

The packaged fibrous material bale is typically a cube or rectangular prism. When the packaged fibrous material bale is in the shape of a rectangular prism, the tabs, e.g., one, two, three, or four tabs, may be oriented to form corner folds on the longer sides of the rectangular prism, as is shown in FIG. 4, rather than on the shorter sides. In some aspects, the tabs are folded first, so that they are in contact with the fibrous material (or liner if used). This allows the tabs to be folded in and secured by folding the remaining material of the lower sheet over the tab to form a corner fold.

In some aspects, the upper sheet and/or lower sheet may be folded prior to wrapping the at least one side sheet around the bale. In other aspects, the at least one side sheet may be wrapped around the bale and then the upper sheet and/or lower sheet may be folded around the side sheet.

In some aspects, the at least one side sheet may also have a slit or score as described herein, to allow for wrapping around the bale. In other aspects, the at least one side sheet does not have any slits or scores.

Once the upper sheet, lower sheet, and at least one side sheet are in place, they are secured as described herein to form a packaged bale. The packaging (e.g., the upper sheet, lower sheet, and at least one side sheet) enclose 100% of the surface area of the compressed fibrous material (the bale), or of the liner if the compressed fibrous material is enclosed in a liner. Generally, the packaging step is performed within one hour of pressing, e.g., within 30 minutes, within 15 minutes, or within 10 minutes.

Once the packaging is secured and the press is opened to release the packaged bale, the package may expand vertically, and laterally, as the fibrous material fills the package, causing the packaging materials to stretch. When the packaging materials stretch, the vertical compressive force in the fibrous material drops, but may still be at a pressure of up to about 5 N/cm$^2$. The compressive force may remain in this range for approximately 48 hours. It may be gradually reduced during this time. At 48 hours, the forces are generally understood to have substantially equilibrated and for this reason, a 48 hour storage period is used to inspect for packaging failure.

In some aspects (not shown), the fibrous material has been compressed prior to being placed between the lower sheet and the upper sheet. In these aspects, a lower platen and an upper platen are not necessary and the sheets may be manually placed over the fibrous material.

Once the fibrous material has been compressed, either prior to being placed between the lower sheet and the upper sheet, or after placing, the packaging is conducted preferably at ambient temperature and pressure.

After a period of 48 hours of storage, generally at ambient temperature and pressure, the packaged bale is inspected. When the packaging is conducted according to the present invention, less than 1% of the surface area of the bale (or the liner) is visible, e.g., less than 0.5%, less than 0.1% or less than 0.01%. Put in terms of a 1 meter by 1 meter square bale, less than 600 square centimeters would be visible, e.g., less than 60 square centimeters, less than 30 square centimeters, less than 15 square centimeters, less than 10 square centimeters, less than 6 square centimeters less than 3 square centimeters, less than 0.6 square centimeters, or less than 0.06 square centimeters. Thus, the packaging covers greater than or equal to 99% of the surface area of the bale (or liner) after the packaged bale has been stored for at least 48 hours, e.g., greater than or equal to 99.5%, greater than or equal to 99.9%, or greater than or equal to 99.99%. In some aspects, a minimal amount of surface area is exposed, e.g., 0.001 to 1 wt. %. In terms of lower limits, at least 0.001 square centimeters of the bale may be exposed, e.g., at least 0.01 square centimeters, or at least 0.05 square centimeters. Thus, the range of exposed surface area of the bale of fibrous material may range from 0.001 to 600 square centimeters, e.g., from 0.001 to 60 square centimeters, from 0.001 to 6 square centimeters, from 0.01 to 6 square centimeters, from 0.001 to 3 square centimeters, from 0.001 to 0.6 square centimeters, from 0.001 to 0.06 square centimeters, from 0.01 to 6 square centimeters, from 0.05 to 6 square centimeters, and all ranges therebetween.

In addition to reducing the percentage of visible surface area of the bale (or liner), the present invention also results in the reduction of the ratio of the percentage of visible surface area to the percentage of vertical expansion of the bale. In some aspects, the ratio is 1:1 or less, e.g., 0.9:1 or less, 0.8:1 or less, or 0.7:1 or less. Such a reduction in the ratio reflects the give in the packaging, since it illustrates that even as the vertical expansion increases, the visible surface area, e.g., increases at a lesser rate, if at all.

EXAMPLES

Example 1

Figure 5:
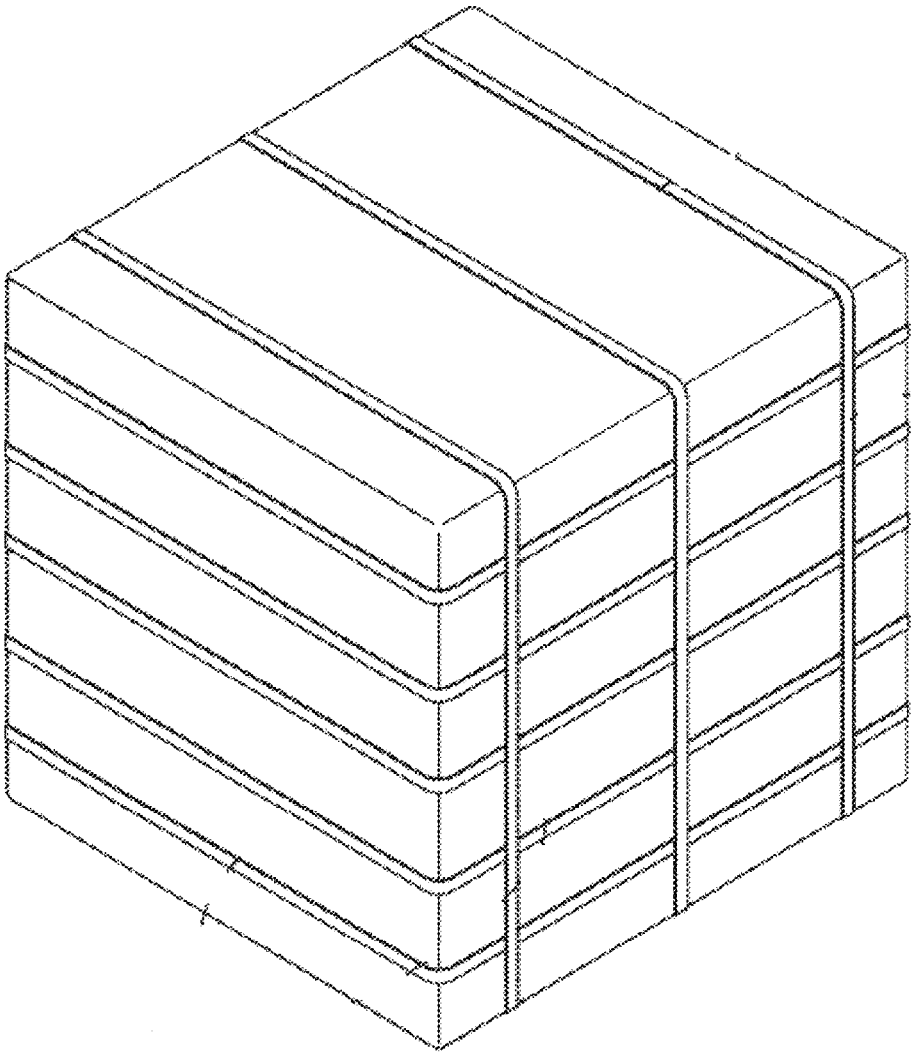
FIG. 5 is an illustration of a packaged fibrous material bale in accordance with aspects of the present invention.

Packaged cellulose acetate tow bales were prepared using a lower sheet as shown in FIG. 4. The total surface of the packaged tow bale, the total exposed surface of the fibrous material, and the total covered surface area of the packaged tow bale were measured immediately out of the press. The results are shown in Table 1. FIG. 5 provides an illustration of the packaged fibrous material bale formed by Example 1.

TABLE 1

| | Total Surface (cm2) | Total Exposed (cm2) | Total covered (cm2) | % Coverage |
|---|---|---|---|---|
| Mean | 69535.71 | 2.60 | 69533.12 | 99.996 |
| Median | 69412.50 | 2.50 | 69409.75 | 99.996 |
| SD | 1459.53 | 2.48 | 1459.88 | 0.004 |
| CV | 2.10 | 95.39 | 2.10 | 0.359 |

Comparative Example A

Packaged cellulose acetate tow bales were prepared as in Example 1, except that the lower sheet did not have tabs and instead had slits at each corner to allow for folding. The total surface of the packaged tow bale, the total exposed surface of the fibrous material, and the total covered surface area of the packaged tow bale were measured immediately out of the press. The results are shown in Table 2.

TABLE 2

| | Total Surface (cm2) | Total Exposed (cm2) | Total covered (cm2) | % Coverage |
|---|---|---|---|---|
| Mean | 68473.63 | 12.43 | 68461.20 | 99.982 |
| Median | 68027.00 | 12.65 | 68013.50 | 99.981 |
| SD | 1855.91 | 1.30 | 1855.67 | 0.0019 |
| CV | 2.71 | 10.50 | 2.71 | 0.0019 |

As can be seen, the mean and median exposed fibrous material was significantly increased for the Comparative Example, prepared without tabs, as compared to Example 1. The above examples therefore illustrate the surprising and unexpected benefit to including tabs as described in Example 1 and as illustrated in FIG. 4.

Example 2

Packaged cellulose acetate tow bales were prepared as in Example 1 and the bottom gaps were measured immediately out of the press and then again after a period of two weeks. The results are shown below in Table 3.

TABLE 3

| | | Exposed Bottom Gaps (cm2) |
|---|---|---|
| Immediately out of press | Mean | 2.05 |
| | Median | 1.50 |
| | SD | 2.49 |
| | CV | 121.39 |
| After 2 weeks of storage | Mean | 2.37 |
| | Median | 1.60 |
| | SD | 2.20 |
| | CV | 92.93 |

Comparative Example B

Packaged cellulose acetate tow bales were prepared as in Example 2 and the bottom gaps were measured immediately out of the press and then again after a period of two weeks. The results are shown below in Table 4.

TABLE 4

| | | Exposed Bottom Gaps (cm2) |
|---|---|---|
| Immediately out of press | Mean | 12.23 |
| | Median | 12.55 |
| | SD | 1.36 |
| | CV | 11.12 |
| After 2 weeks of storage | Mean | 17.55 |
| | Median | 16.73 |
| | SD | 5.13 |
| | CV | 29.20 |

As seen by comparing Example 2 and Comparative Example B, there is an 83% improvement in bottom gap size immediately out of the press and an 86% improvement in bottom gap size after two weeks of storage. These results again indicate the improvement due to include the tabs on the lower sheet.

The following embodiments are contemplated:

Embodiment 1: A packaged fibrous material bale comprising: a) a fibrous material bale having an upper surface, a lower surface, and side surfaces; and b) packaging enclosing at least 99% of surface area of the fibrous material bale, the packaging comprising: i) an upper sheet enclosing the upper surface; and ii) a lower sheet enclosing the lower surface of the fibrous material bale and a portion of the side surfaces, a) wherein the lower sheet comprises a corner fold enclosing at least a portion of one of the side surfaces; and b) wherein the lower sheet comprises a tab located at or proximate to the corner fold.

Embodiment 2: The packaged fibrous material bale of Embodiment 1, wherein a length of the tab is from 30 to 99% of the corner fold height along the portion of one of the side surfaces.

Embodiment 3: The packaged fibrous material bale of Embodiment 1 or 2, wherein the lower sheet comprises two tabs, preferably three tabs, more preferably four tabs.

Embodiment 4: The packaged fibrous material bale of any of the preceding Embodiments, wherein the packaging further comprises a side sheet, wherein the side sheet overlaps the upper sheet and lower sheet.

Embodiment 5: The packaged fibrous material bale of any of the preceding Embodiments, wherein the fibrous material bale comprises cellulose acetate tow.

Embodiment 6: The packaged fibrous material bale of any of the preceding Embodiments, wherein the lower sheet consists of a continuous sheet with slits located at the tab.

Embodiment 7: The packaged fibrous material bale of any of the preceding Embodiments, wherein the lower sheet has at least one set of score lines along a longitudinal length of the lower surface, preferably along a longitudinal length of at least two sides of the lower surface, more preferably along a longitudinal length of at least three sides of the lower surface, most preferably along a longitudinal length of at least four sides of the lower surface.

Embodiment 8: The packaged fibrous material bale of any of the preceding Embodiments, wherein the at least one set of score lines comprises three sets of parallel score lines along a longitudinal length of the lower surface.

Embodiment 9: The packaged fibrous material bale of any of the preceding Embodiments, wherein the fibrous material bale comprises two shorts sides and two long sides, and wherein the tab extends onto one of the two long sides.

Embodiment 10: The packaged fibrous material bale of any of the preceding Embodiments, wherein the lower sheet comprises a tab located at or proximate to at least two corner folds.

Embodiment 11: The packaged fibrous material bale any of the preceding Embodiments, wherein d) a width of the tab is from 60% to less than 100% of the width between a set of innermost score lines and a set of outermost score lines Embodiment 12: The packaged fibrous material bale any of the preceding Embodiments, wherein greater than 99.5% of the surface area of the tow bale is enclosed by the packaging, preferably greater than 99.9%, more preferable greater than 99.99%, as measured after the packaged fibrous material bale is stored for at least 48 hours.

Embodiment 13: A method for packaging a tow bale, the method comprising: a) placing fibrous material between an upper sheet and a lower sheet, wherein the lower sheet comprises at least one tab along a longitudinal length of the lower sheet; b) compressing the fibrous material in a press to form a fibrous material bale; c) enclosing the surface area of the fibrous material bale with packaging comprising the upper sheet and the lower sheet, i) wherein at least a portion of the lower sheet comprising the tab is folded around at least one side of the fibrous material bale to form a corner fold; and d) securing the packaging around the fibrous material bale to form a packaged fibrous material bale; wherein at least 99% of the surface area of the fibrous material bale is enclosed by the packaging after the packaged fibrous material bale is stored for at least 48 hours.

Embodiment 14: The method of Embodiment 13, wherein the lower sheet has a longitudinal score line.

Embodiment 15: The method of Embodiment 13 or 14, wherein the lower sheet has at least two parallel longitudinal score lines.

Embodiment 16: The method of any of Embodiments 13-15, wherein the lower sheet is scored in each corner.

Embodiment 17: The method of any of claims 13-16, wherein the packaging further comprises at least one side sheet Embodiment 18: The method of any of Embodiment 13-17, wherein the fibrous material bale comprises cellulose acetate.

Embodiment 19: The method of any of Embodiments 13-18, wherein step a) further comprises enclosing the fibrous material in a non-sealed liner prior to placing the tow between the upper sheet and the lower sheet; and further wherein at least 99% of the surface area of the non-sealed liner is enclosed by the packaging after the bale is stored for at least 48 hours, preferably at least 99.5%, more preferably at least 99.9%, most preferably at least 99.99%.

Embodiment 20: The method of any of Embodiments 13-19, wherein the packaging comprises a cardboard material.

Embodiment 21: The method of any of Embodiments 13-20, wherein step d) comprises applying straps around the packaging, preferably plastic straps.

Embodiment 22: The method of any of Embodiments 13-21, wherein step d) comprises applying strap(s) horizontally and/or vertically around the packaging.

While the invention has been described in detail, modifications within the spirit and scope of the invention will be readily apparent to those of skill in the art. It should be understood that aspects of the invention and portions of various embodiments and various features recited herein and/or in the appended claims may be combined or interchanged either in whole or in part. In the foregoing descriptions of the various embodiments, those embodiments which refer to another embodiment may be appropriately combined with other embodiments as will be appreciated by one of ordinary skill in the art. Furthermore, those of ordinary skill in the art will appreciate that the foregoing description is by way of example only, and is not intended to limit the invention.

We claim:

1. A packaged fibrous material bale, comprising:

a) a fibrous material bale having an upper surface, a lower surface, and side surfaces, wherein the fibrous material is cellulose acetate tow; and b) a packaging enclosing at least 99% of surface area of the fibrous material bale, the packaging comprising:

i) an upper sheet enclosing the upper surface; and ii) a lower sheet enclosing the lower surface of the fibrous material bale and a portion of the side surfaces, a) wherein the lower sheet comprises a corner fold enclosing at least a portion of one of the side surfaces;

b) wherein the lower sheet comprises at least one tab located at or proximate to the corner fold; and c) wherein the at least one tab covers at least a portion of a corner of the bale;

c) wherein the packaged fibrous material bale is substantially flat on the upper surface and the lower surface.

2. The packaged fibrous material bale of claim 1, wherein a length of the at least one tab is from 30 to 99% of the corner fold height along the portion of one of the side surfaces.

3. The packaged fibrous material bale of claim 1, wherein the at least one tab on the lower sheet is two tabs.

4. The packaged fibrous material bale of claim 1, wherein the packaging further comprises a side sheet and wherein the side sheet overlaps the upper sheet and lower sheet.

5. The packaged fibrous material bale of claim 1, wherein the lower sheet consists of a continuous sheet with slits located at the at least one tab.

6. The packaged fibrous material bale of claim 1, wherein the lower sheet has at least one set of score lines along a longitudinal length of the lower surface.

7. The packaged fibrous material bale of claim 6, wherein the at least one set of score lines comprises three sets of parallel score lines along a longitudinal length of the lower surface.

8. The packaged fibrous material bale of claim 1, wherein the fibrous material bale comprises two short sides and two long sides, and wherein the at least one tab extends onto one of the two long sides.

9. The packaged fibrous material bale of claim 1, wherein the lower sheet comprises the at least one tab located at or proximate to at least two corner folds.

10. The packaged fibrous material bale of claim 1, wherein a width of the at least one tab is from 60% to less than 100% of the width between a set of innermost score lines and a set of outermost score lines.

11. The packaged fibrous material bale of claim 1, wherein greater than 99.5% of the surface area of the tow bale is enclosed by the packaging, as measured after the packaged fibrous material bale is stored for at least 48 hours.

12. A method for packaging a cellulose acetate tow bale, the method comprising:

a) placing fibrous material between an upper sheet and a lower sheet, wherein the lower sheet comprises at least one tab along a longitudinal length of the lower sheet and wherein the fibrous material is cellulose acetate tow;

b) compressing the fibrous material in a press to form a fibrous material bale;

c) enclosing the surface area of the fibrous material bale with packaging comprising the upper sheet and the lower sheet;

i) wherein at least a portion of the lower sheet comprising the at least one tab is folded around at least one side of the fibrous material bale to form a corner fold; and ii) wherein the at least one tab covers at least a portion of a corner of the bale;

d) securing the packaging around the fibrous material bale to form a packaged fibrous material bale;

wherein the packaged fibrous material bale is substantially flat on an upper surface and a lower surface; and wherein at least 99% of the surface area of the fibrous material bale is enclosed by the packaging after the packaged fibrous material bale is stored for at least 48 hours.

13. The method of claim 12, wherein the lower sheet has a longitudinal score line.

14. The method of claim 12, wherein the lower sheet has at least two parallel longitudinal score lines.

15. The method of claim 12, wherein the lower sheet is scored in each corner.

16. The method of claim 12, wherein the packaging further comprises at least one side sheet.

17. The method of claim 12, wherein step a) further comprises enclosing the fibrous material in a non-sealed liner prior to placing the tow between the upper sheet and the lower sheet; and further wherein at least 99% of the surface area of the non-sealed liner is enclosed by the packaging after the bale is stored for at least 48 hours.

18. The method of claim 12, wherein the packaging comprises a cardboard material.

* * * * *